United States Patent [19]

Himmelheber, Sr.

[11] 4,217,830

[45] Aug. 19, 1980

[54] COLLAR AROUND TANK CAR DOME AREA

[75] Inventor: Jack L. Himmelheber, Sr., New Albany, Ind.

[73] Assignee: SCM Corporation, New York, N.Y.

[21] Appl. No.: 885,775

[22] Filed: Mar. 13, 1978

[51] Int. Cl.[3] ..... B61D 5/00

[52] U.S. Cl. ..... 105/360; 114/74 A

[58] Field of Search ..... 105/358, 360, 423, 279, 105/394; 220/85 R, 85 E, 365, DIG. 21, DIG. 24; 114/74 R, 74 A; 249/82; 52/578

[56] References Cited

U.S. PATENT DOCUMENTS

| | | | |
|---|---|---|---|
| 2,659,523 | 11/1953 | Comber | 280/153 B |
| 3,159,249 | 12/1964 | Lazan | 52/573 |
| 3,589,303 | 6/1971 | Lakin | 105/358 |
| 3,599,575 | 8/1971 | Yurkoski | 220/452 |

*Primary Examiner*—Edward R. Kazenske
*Attorney, Agent, or Firm*—Richard H. Thomas

[57] ABSTRACT

A protective collar for tank cars, which are used for the transport of materials capable of causing corrosion on the exterior surface of the tank car, is formed approximately in the shape of a downwardly facing C and is placed over the exterior upper surface of the car in the area of the car manway and associated fixtures, normally midway between the car ends. The collar is made of stainless steel or other such protective materials and is provided with apertures to accommodate the tank car manway and associated fixtures. The collar preferably is secured to the exterior surface of the car by means of a frame welded to the car surface and slidingly engaging the periphery of the collar to accommodate differential expansion between the collar and car.

1 Claim, 4 Drawing Figures

COLLAR AROUND TANK CAR DOME AREA

The present invention relates to a protective collar for railroad tank cars used for transporting materials capable of causing corrosion of the exterior surface of the tank cars.

BACKGROUND OF THE INVENTION

The present invention is particularly applicable to the protection of tank cars used for the transport of crude and refined vegetable oils. During loading of such vegetable oils, the same are often spilled or splattered onto the outside of the tank cars, in the area of the car manway, normally midway between the car ends. This may, by way of example, be caused by expansion of the oil in a fully loaded car, at the time of unloading, if a user of the oil inadvertently heats the oil to a temperature higher than that required for the unloading step. When exposed to air, the vegetable oils polymerize. This results in a black, solid, unsightly mass which, in addition to presenting an unattractive appearance, collects dirt and other road debris and is unsanitary.

It is possible to remove the polymerized oil, by the use of bio-degradable detergents and/or hot water under high nozzle pressure. However, the polymerized oils tend to soften the epoxy paint conventionally used on tank cars, and the paint, in such softened condition, is readily removed with the polymerized oils. The exposed areas of the tank car then immediately begin to deteriorate and rust, also presenting an unsightly and unsanitary appearance. All this is particularly detrimental for the transportation of food items, such as edible vegetable oils, where a good image and sanitary appearance are of critical importance, Attempts have been made to overcome the problem, for instance, by the application of various coatings such as urethanes to the exterior surface of the tank cars. However, these coatings do not provide adequate protection, and still permit deterioration of the exterior surface of the tank cars and development of a less than satisfactory appearance.

Accordingly, it is an object of the present invention to provide a protective collar or shield around the exterior surface of the tank car, in the area of the car manway and associated fixtures, which is capable of being readily cleaned without damage to the tank car surfaces or finishes thereof.

It is also an object of the present invention to provide such a tank car collar which is simple in construction, economical in cost, and efficient in operation, and means by which the collar is readily installed on the tank car.

Known prior art is disclosed in prior U.S. Pat. Nos. 2,659,523 and 3,599,575. In the first of these patents, No. 2,659,523, there is disclosed a protective bib for disposal over the open end of a filling pipe of a vehicle, primarily a gas tank filling pipe for an automobile. No reference is made in this patent to the problems to which the present invention is directed, namely the transport of materials capable of causing corrosion in tank cars. The second U.S. Pat. No. 3,599,575 discloses the application of a fiberglas polyester resin coat to the outer surface of a rigid polyurethane foam layer on insulated covered hopper railway cars in areas exposed to wear and abrasion. This patent also is not directed to the problems which confronted applicant in connection with the present invention.

SUMMARY OF THE PRESENT INVENTION

By the present invention, there is provided a protective collar for tank cars which are used for the transport of materials capable of causing corrosion of the exterior surface of the tank car. The collar is approximately C-shaped and is adapted to conform to and embrace the exterior upper surface of the tank car in the area of the can manway and associated fixtures, normally midway between the car ends. The collar is made of stainless steel or other protective material, and is provided with apertures to accommodate the tank car manway and associated fixtures.

The collar preferably is secured to the tank car exterior surface by means of a frame welded to the car surface and slidingly engaging the collar periphery. This permits differential expansion of the collar and tank car. Caulking preferably is positioned in the frame slot accommodating the collar to seal the spacing between the frame and collar.

Preferably the collar is made of four sheets of thin gauge stainless steel about 10 feet in length. Such sheets normally come in four and a half foot widths, and when fastened together, form a collar which is of sufficient dimension to carry it below the mid-point elevation of the car, in the shape of a C, to the underside of the car. This effectively covers the full run-off area along the car sides. The sheets of stainless steel may be seam welded, riveted, or crimped together.

For installation, the tank car walkway or running board and side ladders are removed and the collar is installed in place. The walkways and ladders are then replaced. Where walkway and ladder connections overlie the collar, cutouts preferably are made to permit welding such connections directly to the car.

The present invention and advantages thereof will become further apparent from the following detailed description, taken in conjunction with the accompanying drawings, in which.

Figure 1:
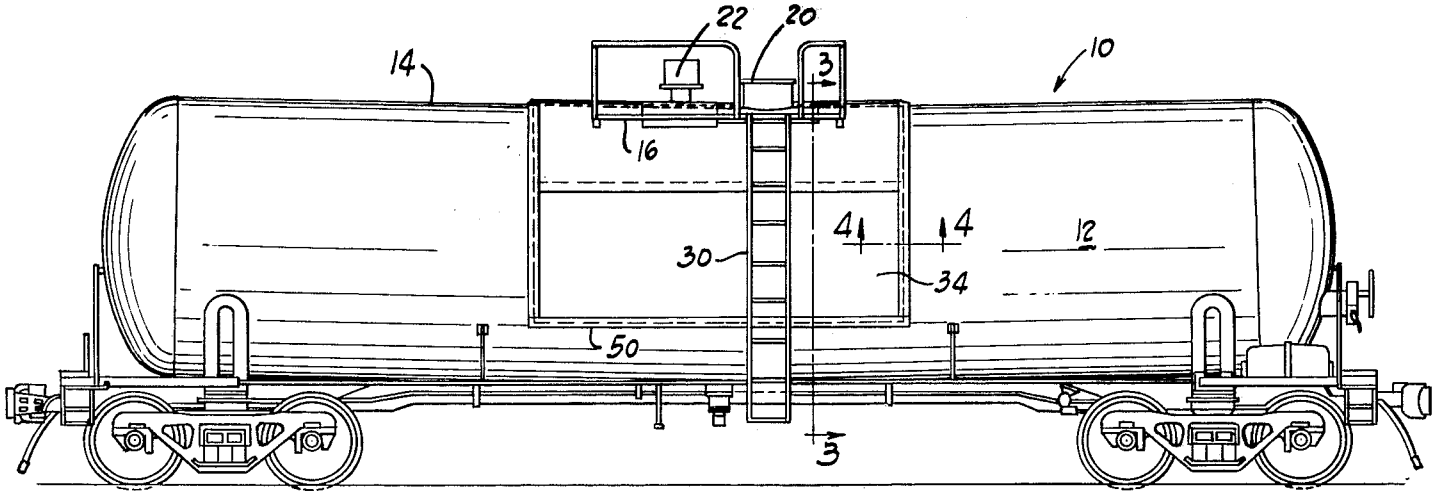
FIG. 1 is a vertical elevation view illustrating a railroad tank car and protective collar in place, in accordance with the concepts of the present invention.

Referring now to the drawings, a tank car is generally indicated with the number 10 having opposed sides 12 and a roof 14. The car is generally cylindrical in shape, as is conventional and has the usual walkways 16 and 18 on opposite sides of the car centerline, a manway or hatch 20, and an associated fixture 22. In the car shown, the fixture 22 is for bomb sampling of the car contents, and also for opening a valved outlet in the bottom of the car. Not shown, is a vent valve normally employed on tank cars. These items are located generally along the centerline on the top of the tank car. On opposite sides, the tank car is provided with ladders 30 and 32 extending from the walkways 16 and 18 to the bottom of the tank car.

In practice, the tank car is used for delivery of crude and refined vegetable oils. Loading usually takes place through the manway 20. Unloading may take place through the manway, or alternatively through a bottom valved outlet. During loading and unloading, spillage or splashing of vegetable oil onto the outside of the car easily occurs. In addition, it is common practice for a user of the oil to heat it to facilitate unloading. Frequently the oil is inadvertently heated to too high a temperature causing expansion of the oil and overflow, from a fully loaded car, onto the car sides. Obviously the spillage or overflow occurs in the general area of the manway 20 and fixture 22, but frequently is substantial enough to cause accumulation or drippage of the oil far down the tank car sides to the point where the car sides begin to turn under.

On exposure to air, the vegetable oil polymerizes and forms a hard, darkened mass that is only removed by the use of bio-degradable detergents, or caustic strong enough to dissolve the oil, usually in combination with hot water jets at high nozzle pressure.

The primary problem is that the polymerized oil tends to soften the epoxy paint conventionally used to coat tank cars, and the cleaning process quickly removes the paint from the area being treated, presenting an unattractive, unsanitary appearance. No success has been achieved with other coatings, such as urethanes.

In accordance with the concepts of the present invention, a stainless steel collar 34 is fabricated from four sheets of stainless steel, each about 10 feet in length and about four and a half feet in width. The sheets are fastened together along their sides, as shown in dashed lines in FIG. 2, to provide single flat member having an overall width of about 15 feet and 9 inches.

Figure 2:
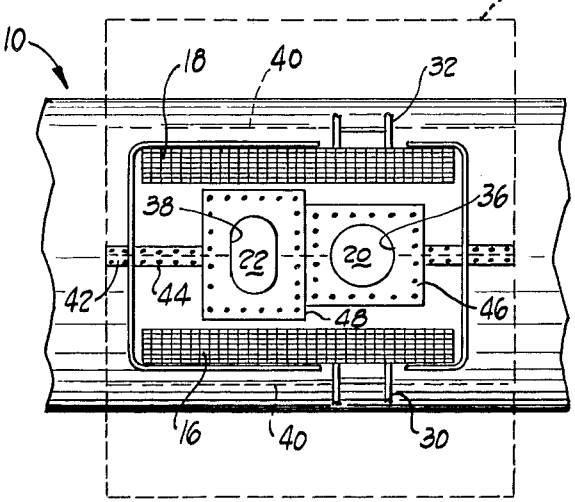
FIG. 2 is a detailed top view of the car of FIG. 1 showing in dashed lines fabrication of the collar into a flat member, prior to installation.

Along the centerline of the fabricated member, apertures 36 and 38, FIG. 2, are made to accommodate the manway 20 and fixture 22.

Figure 3:
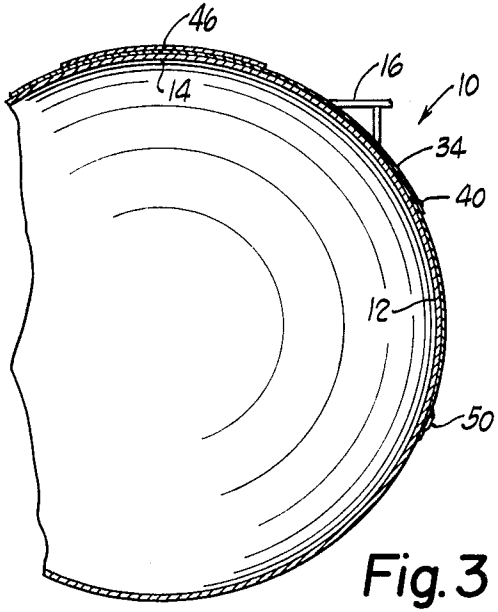
FIG. 3 is a section view taken through line 3—3 of FIG. 1.

In the embodiment illustrated, the sheet sides are crimped together, as indicated at 40, FIG. 3. Along the top, at 42, FIG. 2, the sheets are joined by an overlapping strip 44 of stainless steel riveted to the abutting sheets.

Figure 4:
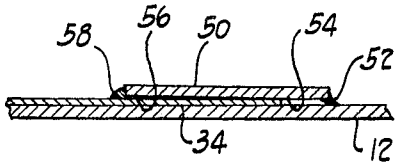
FIG. 4 is a section view taken along line 4—4 of FIG. 1.

To install the collar, the ladders and walkways are first removed from the tank car. A frame is then fabricated and welded to the tank car sides. This is illustrated in FIGS. 1 and 4. The frame 50 essentially is a rectangular member made of four strips of thin, flat steel pieces. These strips are welded to the tank car by a continuous seam weld 52, around the entire outer periphery of the frame. During the welding, the frame pieces are shimmed or otherwise held in spaced relation to the car sides to define an annular pocket or space 54. The fabricated collar is then placed over the manway and associated fixtures and is conformed to slip into the pocket or frame space 54 for engagement by the frame. The dimensions of the space 54 are sufficient to engage not only the stainless steel sheets, normally of 26 gauge or 0.018 inch thickness, but also crimped areas such as at 40, FIG. 3.

Larger overlapping sheets 46 and 48, FIG. 2, are provided encircling the manway 20 and fixture 22 to provide additional protection. Caulking, not shown, may be used to seal the clearance between the sheets 46 and 48 and the manway and fixtures 20 and 22.

Following this, the exposed clearance 56 between the sheets 34 (FIG. 4) and the frame 50 is filled with caulking 58, which may be a rubberized compound or rope caulking.

Instead of fastening the collar 34 to the tank car by means of a frame such as item 50, it would be possible to tack weld or even seam weld it to the car. An advantage of tack welding would be that it would allow breathing of the space between the car sides and collar. Seam welding, or use of a frame, however, offer a more secure means for holding the collar to the car. A special advantage achieved by use of a frame is that this construction accommodates different expansions of the tank car and collar with temperature.

An important feature of the present invention is that the tank car collar should extend downwardly along the sides of the tank car a sufficient distance to turn in underneath the tank car. In this way, oil spilled or splattered onto the collar will drip from the collar down to the roadbed rather than onto unprotected surfaces of the tank car.

Preferably the collar is constructed of stainless steel sheeting of about 0.018 inch in thickness, although the particular thickness is dictated by considerations such as weight, strength, and ease of conforming it to the car sides, and is otherwise not critical. It is also possible to construct the collar of such materials as polished aluminum, durable plastics, and fiberglas.

It should be apparent from the above description that the present invention provides a collar construction which is simple and economical in cost, efficient in operation and easy to place in position on the tank car. At the same time, the present invention effectively prevents the dripping or splattering of corrosive fluids onto painted or other surfaces of the tank cars such that corrosion and damage to such surfaces could result. Still, further, the present invention provides a clean and pleasant appearance, particularly critical for the transport of food oils. The collar is readily cleaned by the use of bio-degradable detergents, caustic or an acid bath, and hot water at high pressure, without damage to the car protective coating, decals or numbers.

It will be apparent to those skilled in the art that the present invention has application for other uses, for instance the transportation of other materials such as salt.

Instead of seam welding the frame 50 to the tank car sides, it can be secured by other means, for instance by tack welding or by the use of screws or bolts threaded into the tank car sides.

What is claimed is:

1. For a tank car having a manway and associated fixtures along the top of the car, the improvement, for the transport of vegetable oils capable of polymerization and the removal of which from the sides of the car normally causes corrosion of the exterior surface of the car, comprising a collar having substantially C-shaped configuration and adapted to conform to the exterior upper and side surfaces of the car in an area embracing said manway cover and associated fixtures for protecting said exterior surface from said corrosion, said collar being of thin gauge stainless steel and having apertures provided therein to receive the manway and associated fixtures, further including axially spaced arcuate marginal frame means welded to the tank car sides for telescopically receiving and holding the longitudinally spaced arcuate edges of the collar between said frame means and the exterior of the car, and longitudinally extending marginal frame means welded on either side of the car for telescopically receiving and holding the lower marginal edges of the collar between said frame means and the exterior of the car, said collar extending downwardly along the tank car sides below the point where said sides commence to turn in underneath the car.

* * * * *

UNITED STATES PATENT AND TRADEMARK OFFICE

CERTIFICATE OF CORRECTION

PATENT NO. : 4,217,830

DATED : August 19, 1980

INVENTOR(S) : Jack L. Himmelheber, Sr.

It is certified that error appears in the above-identified patent and that said Letters Patent are hereby corrected as shown below:

Column 1, line 12, after "loading", insert --and unloading--.

Signed and Sealed this

*Ninth* Day of *December 1980*

[SEAL]

*Attest:*

SIDNEY A. DIAMOND

*Attesting Officer*

*Commissioner of Patents and Trademarks*